US005300390A

United States Patent [19]

Landa et al.

[11] Patent Number: 5,300,390

[45] Date of Patent: Apr. 5, 1994

[54] LIQUID TONER COMPOSITION

[75] Inventors: Benzion Landa, Edmonton, Canada; Yaacov Almog, Rehovot, Israel; Peretz Ben-Avraham, Rehovot, Israel; Moshe Levanon, Rehovot, Israel

[73] Assignee: Spectrum Sciences, B.V., Wassenaar, Netherlands

[21] Appl. No.: 836,574

[22] Filed: Feb. 18, 1992

[51] Int. Cl.[5] ..... G03G 9/135

[52] U.S. Cl. ..... 430/115; 430/137

[58] Field of Search ..... 430/114, 115, 137

[56] References Cited

U.S. PATENT DOCUMENTS

| | | | |
|---|---|---|---|
| 3,850,829 | 11/1974 | Smith et al. | 430/116 |
| 4,794,651 | 12/1988 | Landa et al. | 430/114 |
| 5,019,477 | 5/1991 | Felder | 430/114 |

*Primary Examiner*—John Goodrow

*Attorney, Agent, or Firm*—Kenyon & Kenyon

[57] ABSTRACT

An improved liquid toner composition for developing latent electrostatic images comprising toner particles, a release agent and a nonpolar dispersant liquid. An agent causing an apparent increase in the cohesivity of the toner particles may be included in the toner composition, or such agent may be used independently of the release agent in the toner composition.

15 Claims, No Drawings

LIQUID TONER COMPOSITION

This invention relates to improved liquid toner compositions for developing latent electrostatic images and transferring the developed images to carrier sheets. The improved liquid toner compositions may be advantageously used in connection with developing latent electrophotographic images. In one embodiment, the compositions of this invention are an improvement of the liquid toner compositions described and claimed in copending patent application Ser. No. 679,906, filed Dec. 10, 1984, the disclosure of which is incorporated herein by reference.

The present invention provides improved liquid toner compositions that demonstrate high transfer efficiencies of the images developed with the toner compositions of this invention when the toner images are transferred from the photoconductive layers to the carrier sheets. The improved transfer efficiencies provided by the liquid toner compositions of this invention are obtained without losing any of the advantages of prior art liquid toners, such as the liquid toners of said Ser. No. 679,906.

BACKGROUND OF THE INVENTION

An electrostatic image may be created by charging a photoconductive layer with a uniform electrostatic charge and thereafter imagewise discharging the electrostatic charge by exposing it to radiant energy in the non-image areas. It will be understood that other methods may be employed to form an electrostatic image, such as, for example, by imagewise transfer of a preformed electrostatic charge to the surface of a carrier that has a dielectric surface. Moreover, the charge may be formed from an array of styluses.

After the latent electrostatic image has been formed, the image may be developed by applying to the latent electrostatic image a liquid developer composition comprising a dispersion of toner particles (which may be pigmented) and, preferably, a charge director. Development takes place when the toner particles electrostatically adhere to the imagewise charge on the photoconductor and are removed from the non-charged areas. In the so-called reversal development process the charged toner particles adhere to the non-charged areas of the photoconductor.

The carrier liquid in which the toner particles, charge director and other ingredients in the developer composition are dispersed is an insulating, nonpolar liquid having and a high-volume resistivity in excess of $10^9$ ohm-centimeters, and a low dielectric constant, i.e., below about 3.0. Suitable carrier liquids in which the toners may be dispersed include aliphatic, isomerized hydrocarbons such as the aliphatic hydrocarbons sold by the Exxon Corporation under the trademark ISOPAR. Different types of ISOPARs are available having different distillation end points and vapor pressures. Light mineral oils which are higher boiling aliphatic hydrocarbon liquids may also be used.

After the latent image on the photoconductive layer has been developed the toner particles are transferred imagewise to a carrier sheet where the particles adhere imagewise to the sheet. For example, the developed image may be transferred to a sheet of paper, and the toner image may thereafter be fixed. It has been observed that during the transfer step the toner image may be smudged, smeared, or squashed thereby reducing the resolution, sharpness, line acuity—that is, edge acuity—and clarity of the final image. Furthermore, the toner images made with liquid toner compositions of the prior art are not completely transferred from the photoconductor to the carrier sheet. A result of such incomplete toner transfer is that the image on the carrier sheet evidences image defects, such as, low optical density, pinholes, non-uniformity in the image areas, hollow characters in the image areas, and the like. Moreover, leaving a residue of toner particles on the photoconductor presents problems for cleaning the engine of the electrostatic reproduction machine prior to the next cycle of image reproduction on the photoconductor. Residual toner on the photoconductor during the next cycle will result in a dirty image on the carrier sheet.

With specific references to said Ser. No. 679,906, the toner particles are prepared from certain thermoplastic polymer resins by processes that provide the toner particles with a morphology of a plurality of fibers as defined therein. The fiber toner particles may interdigitate, intertwine, or interlink physically providing a developed, transferred, squash-resistant image having superior sharpness, line acuity and a high degree of resolution. The salient feature of the toner particles and the developed images made with such toners is that the particles and images have good compressive strength thereby allowing the developed images to be transferred from the photoconductor surface on which they are developed to carrier sheets without being squashed.

The thickness of the developed image mass can be controlled by varying any one or more of the charge on the photoconductor, the development time, the concentration of toner particles in the developer dispersion, the charge characteristics of the toner particles, the toner particle size, and the surface chemistry of the toner particles. Because of the intertwining property of the toner particles, as described in said Ser. No. 679,906, a thicker developed image may be created on the photoconductor layer which is then transferred to the carrier sheet, and yet the toner image on the carrier sheet is very sharp. Accordingly, the fiber toner particles of Ser. No. 679,906 provide thicker developed images without the need to resort to the procedures of the prior art that may result in other disadvantages such as more complex machines, additional and expensive chemicals, longer times to make copies, poorer image quality, and the like.

The fiber toner particles of Ser. No. 679,906 may be prepared by dispersing or dissolving a pigment in a plasticized polymer at a temperature of between about 65° C. and 100° C., allowing the dispersion to solidify and form a sponge, and then grinding the sponge to the appropriate particle size and fiber morphology. It is estimated that the average particle size is in the range of about 1-3 microns. Another method is to dissolve one or more thermoplastic polymers in a nonpolar dispersant liquid together with a pigment, such as carbon black or the like, and thereafter the mixture is allowed to cool slowly with stirring during which time the pigmented fiber toner particles precipitate. In a preferred embodiment, the precipitated particles are ground to provide the desired particle size as well as allowing further dispersion of the pigment in the polymer. A third method is to heat a thermoplastic polymer above its melting point and disperse therein a pigment, and thereafter the pigmented thermoplastic polymer is pulled apart by grinding to form fiber particles without first forming a sponge. Dyes may be used in addition to or in place of pigments.

The fibrous toner particles, formed by any of the foregoing methods, are dispersed in a nonpolar carrier liquid, together with one or more charge directors to form the liquid toner/developer composition. Charge directors are well known in the art. Charge directors, which are well known in the field of liquid toner/-developer compositions, must be soluble or dispersible in the carrier liquid dispersant and should cause charging of the imaging toner particles. Examples of charge directors are basic barium petronate and other petronates, di-tridecyl sodium sulfosuccinate (known as Aerosol TR) and other sulfosuccinates, soybean lecithin, cobalt octoate and other octoates, cobalt naphthanate and other naphthanates, and the like.

The thermoplastic polymers of Ser. No. 679,906 include ethylene vinyl acetate copolymers sold by DuPont under the ELVAX trademark and ELVAX II resins which are ethylene copolymers combining carboxylic acid functionality, high molecular weight, and thermal stability. Other polymers which are usable are isotactic polypropylene (crystalline), polybutyl terephthalate, the ethylene ethyl acrylate series sold by Union Carbide under the trademark BAKELITE, other ethylene vinyl acetate resins, methacrylate resins, such as polybutyl methacrylate, polyethyl methacrylate, and polymethyl methacrylate, polyvinyl chloride and polyamides. Plasticizers may be included in the polymeric compositions.

The polymers may be pigmented or dyed so as to render the developed image visible. The pigment may be present in the amount of about 3 percent to about 60 percent by weight of the polymer. If a dye is used, it may be present in an amount of between 1 percent or lower and about 25 percent by weight of the polymer. If no colorant is used—as, for example, in making a toner for developing a latent image for a printing plate—a minor amount of silica, such as Cabosil, may be added to make the grinding easier.

DESCRIPTION OF THE INVENTION

The factors that have an effect on the imagewise transfer efficiency of the toner image include the cohesivity of the toner image, i.e., the degree to which the toner particles are held together as by some force of cohesion or some interlocking mechanism, and the adhesivity of the toner image to the photoconductor surface.

For instance, it has been noted that when the toner particles are not sufficiently cohesive, the particles tend to separate from each other during the transfer step from the photoconductor surface to the carrier sheet. In other words, some of the particles that form the developed toner image on the photoconductor tend to disengage from one another and remain on the photoconductor surface rather than transfer to the carrier sheet. Consequently, the toner particles that do transfer to the carrier sheet form a toner image of reduced density on the carrier sheet. Furthermore, toner particles of insufficient cohesivity tend to become squashed during transfer to the carrier sheet thereby reducing sharpness, edge acuity and resolution of the transferred image. This problem was addressed by the invention of Ser. No. 679,906 by providing toner particles with a morphology of a plurality of fibers. Transfer efficiencies in the range of 60 percent or greater up and to about 85–90 percent have been obtained with the fiber toner particles of that invention.

The degree of adhesivity of the image toner particles to the surface of the photoconductor has an effect on the quantity of toner particles that are transferred to the carrier sheet to form a permanent image. In other words, adhesivity determines the ease with which the image toner particles are disengaged from the photoconductor surface and thereby become free to transfer to the carrier sheet. The greater the reduction in the adhesion of the toner particles to the photoconductor surface the higher will be the transfer efficiency of the toner particles, and the quality of the transferred toner image on the carrier sheet will be improved.

It has now been found that the toner particles of the prior art, including the highly cohesive fiber toner particles described in said Ser. No. 679,906, can be prepared and processed in accordance with the present invention to form a liquid toner/developer composition that demonstrates reduced adhesivity of the toner particles to the photoconductor surface and improved transfer efficiencies, while at the same time the transferred image toner particles do not lose their adhesivity to the carrier sheet. In practice, as demonstrated on xerographic reproduction machines, the transfer efficiencies of such toner particles have been increased substantially, resulting in transferred images having greater uniformity, optical density, sharpness, line acuity, and smudge resistence.

We have discovered that the addition of release agents, such as silicone materials, to liquid toner compositions used to develop latent images on photoconductors improve the transfer efficiencies of the image toner particles without reducing toner adhesivity to the carrier sheets. The preferred release agents include silicone materials such as silicone gels and silicone oils.

By silicone materials we mean to include polymeric siloxanes having repeating silicon-oxygen linkages in the polymer backbone. The silicon atoms may be connected to, for example, alkyl groups such as methyl and ethyl, aryl groups such as phenyl and substituted phenyl, vinyl groups, and hydrogen. Some of these groups may be reactive in a cross-linking reaction. The polysiloxanes may also contain a variety of active and inactive constituent and terminal groups, such as epoxy, hydroxy, alkyl (e.g., methyl), amino, halogen, vinyl, acetoxy and the like. Such polysiloxanes are well known in the art.

In general, addition of the release agents to the liquid toner compositions of the prior art increased image transfer efficiencies and improved the resulting toner images that were obtained on the carrier sheets. The transfer efficiencies of the toner particles described in said Ser. No. 679,906 has been increased from the range of about 85 percent and upwards to the range of about 95–99 percent. Moreover, addition of the release agents of this invention to other liquid toner compositions such as those liquid toners used in the Canon NP-80 machine resulted in transfer efficiencies that were increased from about 70 percent to about 74 percent; the transfer efficiency of the Hunt 11 SN 6800-B liquid toner was increased from about 55 percent to about 60 percent; and the transfer efficiency of the liquid toner used in the Savin V-35 machine (such as the Ricoh R-50 toner) was improved from about 77 percent to about 78 percent. The present invention is also useful in improving the transfer efficiencies of liquid toners such as described in U.S. Pat. Nos. 4,411,976, 4,413,048, 4,454,215, 4,460,667, and 4,582,774. The toner particles described in these patents are not fibrous particles as described in Ser. No. 679,906; they are smoother and rounder and have lower transfer efficiencies.

By the use of the present invention with the prior art liquid toner compositions, transfer efficiencies were increased by up to about 15 percent or more. Moreover, the transferred toner images that resulted from liquid toner compositions to which the release agents were added in accordance with this invention, provided images that had increased solid area image density and thickness, sharper images, greater line acuity and resolution without image smear.

The advantages of the present invention may be more readily understood by referring to the improved transfer efficiencies and noting that the instant invention allows toner particles of the liquid toner/developer composition to be transferred to the carrier sheet in proportions that approach the ideal or maximum level of image transfer, namely 100 percent. This is particularly true with respect to the fiber toner particles of said Ser. No. 679,906. For example, an improvement in transfer efficiency of from about 86 percent to about 93 percent translates into a 50 percent improvement since the amount of image toner particles that remain on the surface of the photoconductors is reduced by half thereby providing a substantially greater quantity of image toner particles in the image areas of the carrier sheets. The increased amount of toner particles that transfer to the carrier sheets form more uniform and denser images. Thus, the advantages of the instant invention are seen to provide improved images on the carrier sheets.

It has also been found that addition of silicone materials to the toner particle compositions results in better slide characteristics (also known as high slip) between the image-containing carrier sheets, particularly when paper sheets are used as the carrier sheets. The toner images made according to this invention result in reduced friction between the toner images on the carrier sheets and the undersides of the adjacent carrier sheets, when such sheets are stacked one on the other, as in the finished copy storage trays. This allows the individual sheets of paper to be easily removed from a stacker tray, or other stacks of such copies, without several sheets clinging together.

Because more toner particles are transferred to the carrier sheets the instant invention also allows for reduced developed image masses on the photoconductor surfaces, i.e., a higher liquid to mass ratio may be employed in the liquid toner/developer composition thereby requiring less toner particles to develop the latent image on the photoconductor and to transfer to the carrier sheet to form a dense, permanent image.

We have also found that the liquid toners of this invention are transferred imagewise to carrier sheets more uniformly as well as in greater quantity. In addition to providing increased density in the image areas on the carrier sheets, the more uniform transfer of the toner image reduces the mottle and halo effects in and around the transferred images. Such defects in the carrier images were noticeable with prior art liquid toners in the form of spots or voids in the image areas and dots surrounding the images in the highlight areas. This advantage of the instant invention is immediately apparent since the eye is very sensitive to non-uniformity in images of low optical density (grey shades) and therefore such non-uniformity readily shows up as mottle to the observer. In the denser images that are produced by this invention, the mottle effect is reduced substantially or eliminated. Uniform imagewise transfers of the toner images also reduce or eliminate halo or spots.

We have also found that the charge on the toner particles is not effected by addition of the silicone materials to the image toner particle compositions in accordance with this invention.

Briefly, the instant invention comprises compositions of particles for liquid toner/developer use and release agents for the toner particles. Silicone materials are the preferred release agents and may be combined with the particle compositions in any convenient manner. For example, if the silicone material is in the form of a flowable fluid or oil, it may simply be admixed with the toner composition. Elevated temperatures may assist in the mixing process to provide a uniform blend of the ingredients. However, elevated temperatures may cause the toner polymer particles to soften or even melt, which is undesirable, particularly if the fiber particles of Ser. No. 679,906 are used because under such conditions the fiber particles may lose their fiber morphology.

It is preferred that the silicone material used in this invention be in the form of a silicone gel in which form it is ground before being admixed with the toner composition. Moreover, the gel and toner composition may be further ground to attain uniformly small particle sizes of the components of the order previously noted. After the liquid toner composition and the silicone gel have been well mixed, the combination may be used in conventional electrostatic reproduction machines to develop latent electrostatic images which are thereafter transferred to carrier sheets to form an improved permanent toner image.

Generally, improved transfer characteristics are noted when minimal amounts of silicone materials are added to the liquid toner particles compositions. Preferably the silicone material is present in a range of between about 1 percent and about 30 percent on the basis of the weight of the image toner particles.

The silicone material in gel form, may be prepared by mixing, for example, about 5 percent of silicone materials (polysiloxanes) with about 95 percent of a nonpolar dispersant liquid. The mixture is stirred, optionally under heated conditions, until a gel is formed. The gel is then allowed to come to room temperature and ground to a fine particle size. The preferred proportion of silicone material to nonpolar dispersant liquid is in the range of about 3 percent to about 10 percent by weight. In other words, a composition having between about 97 and 90 parts by weight of nonpolar dispersant and between about 3 and 10 parts by weight of silicone material is prepared. Below about 3 percent, gellation does not easily occur. Above about 10 percent the material becomes too hard for good workability. A 5 percent gel is preferred.

In the gel embodiment of this invention, the silicone materials which may be used in admixture with the toner particles may be prepared from commercially available polysiloxanes. The polysiloxanes may be cross-linked under conditions well known in the art.

In carrying out the process of this invention, the ground gel is believed to be dispersed between the toner particles. When the ground gel particles that are dispersed between the toner particles in the composition come into contact, the gels tend to interact cohesively with themselves. Because the ground gels are cohesively bound, the interdispersed toner particles also behave as if their cohesivity is increased. Thus, the silicone gel material both act as an agent to reduce adhesivity of the toner particles to the photoconductive surface, and an agent that results in an apparent increase in the cohesivity of the toner particles. Silicone oils, however, are not thought to cause an apparent increase in the cohesivity of the toner particles.

It is preferred that the silicone materials that are mixed with the toner particle compositions be in the form of a ground gel. Toner compositions that contain the ground gel according to this invention, in addition to providing increased cohesivity of the toner particles, as noted above, also allow for improved control of such cohesivity. Cohesivity is an inverse function of the ratio of polysiloxane to the nonpolar dispersant liquid used in the process of preparing the gel. The smaller the ratio (in other words, the less polysiloxane for a given amount of nonpolar dispersant liquid), the greater is the cohesivity between the ground gel particles. As described earlier, the ground gel is believed to be dispersed between the toner particles, and when contact between the ground gel is made in the liquid toner composition, the gels tend to form cohesive bonds with themselves causing the interdispersed toner particles to behave as if their cohesivity is increased. Therefore, by adjusting the ratio of polysiloxane to the nonpolar dispersant liquid one may control the cohesivity of the ground gel to a desired value thereby rendering the image formed by the toner particles cohesive, or, if toner particles such as the fiber toner particles of said Ser. No. 679,906 are used in this invention, more cohesive.

Increased particle cohesivity is important to obtaining a good image because cohesivity improves image transfer efficiency and reduces image squash in the transfer process from the photoconducter to the carrier sheet.

Moreover, it has unexpectedly been discovered that the image toner compositions of this invention reduce or limit wicking into the carrier sheet of the carrier liquid that has been carried over to the carrier sheet during transfer of the image toner particles. In liquid toner systems of the prior art, the carrier liquids which were carried over from the photoconductor layers to the carrier sheets tended to penetrate into the interstices of carrier sheets, such as paper. The organic liquid carriers tended to wick out and wet adjacent areas of the carrier sheets, including areas beyond the edges of the toner images. In addition to being unsightly, the carrier sheets became greasy, took on a translucent appearance, and encouraged the image toner particles to spread away from the image areas. It is believed that the gel structure prevents wicking of the carrier liquid that is carried over to the carrier sheet by substantially blocking the carrier liquid from migrating through the gel/-toner image on the carrier sheet to reach the surface of the carrier sheet.

In the course of fixing the image on the carrier sheet, as by heating the carrier sheet, the carrier liquid is evaporated from the image areas providing a dry, clean and attractive carrier sheet that contains the improved image.

Furthermore, as noted the presence of the ground gel in admixture with the image toner particle compositions tends to reduce wicking of the liquid dispersant of the toner composition into an absorbant carrier sheet. It is believed that after the initial surface amount of dispersant liquid that has been carried over to the carrier sheet has been absorbed into the carrier, the ground gel particles of the image form a barrier or otherwise act to block the remaining dispersant liquid in the image from contacting the absorbant carrier sheet and being absorbed therein. As a consequence the transfer efficiency of the image is improved.

Polysiloxanes are polymeric silicones that comprise a skeletal backbone of $$[-\overset{|}{\underset{|}{Si}}-O-]_n$$

moieties and constituent groups are bonded to the backbone silicon atoms and to the terminal silicon and/or oxygen atoms. For example a preferred commercial polysiloxane is available from Dow Corning under its designation SYL-OFF 7600; it is described as a vinyl functional polydimethylsiloxane polymer.

Other useful polysiloxanes include similar polymeric materials of varying molecular weights. Polysiloxane products such as these are described in, for example, U.S. Pat. Nos. 3,445,420, 3,192,187, 2,823,218 and 3,249,581. Other polysiloxanes include those that are available commercially, such as Dow Corning D-536 (an aminosilicone fluid, i.e., the polysiloxane has a terminal amino group), the Dow Corning DC-200 series (silicone oils having viscosities in the range of about 5–200,000 centistokes), Dow Corning SYL-OFF 291, 292 and 294, and General Electric RTV-630A.

The polymerizable polysiloxanes may also be reacted with cross-linking polysiloxane agents such as material available from Dow Corning under its designation SYL-OFF 7601, and described as a hydrogen functional siloxane polymer. It is believed to include a polymerization inhibitor for prolonged shelf life.

Other polysiloxane cross-linkers are available, including SYL-OFF 7048 from Dow Corning (a polysiloxane similar to 7601, but without an inhibitor of polymerization and it is therefore useful for low or room temperature cross-linking), Dow Corning 2-7131 (a fast-curing agent), and RTV-630B from General Electric (a polysiloxane cross-linker).

When polysiloxane oils are used without being cross-linked, it is preferred that the silicone material have a viscosity in the range of about 30,000 centistokes. Although silicone oils with viscosities of between about 500 and 200,000 centistokes may be used, the relative effectiveness of the silicone oils used in this invention decreases when the viscosities deviate appreciably on either side of 30,000 centistokes. For example, the preferred polysiloxanes may have viscosities of between about 10,000 and 60,000 centistokes.

Silicone materials may be added to the toner composition either as uncross-linked silicone oils or as ground cross-linked gels of polysiloxanes.

Furthermore, cross-linking may be caused to occur in the liquid toner composition by adding polysiloxane and the cross-linker directly to the liquid toner composition and allowing the cross-linking reaction to take place in situ. In this embodiment it is thought that the polysiloxanes may cross-link onto the surface of the toner particles thereby improving the attachment of the gel to the toner particles.

The hydrosilation cross-linking reaction is catalyzed in the presence of conventional catalysts such as noble metal complexes. These include platinum catalysts, and other catalysts, are well known in the art. Also included are catalysts such as chloroplatinic acid, or the reaction product of chloroplatinic acid and olefins or organosilicon compounds containing olefinic constituents.

In one preferred embodiment a polysiloxane polymer, such as Dow Corning SYL-OFF 7600, is admixed with a polysiloxane cross-linking material, such as Dow Corning SYL-OFF 7601, in proportion of up to 20 parts of the cross-linker for 100 parts of the polymer. The reactants are combined in a nonpolar dispersant liquid. Preferrably, when a cross-linker is used, it is used in proportion of about 10 percent by weight of the polymer. The cross-linking reaction takes place in the presence of a catalyst which may be included in the commercially available polymer, such as the SYL-OFF 7600 product. An inhibitor may be included in the commercial cross-linker in which case it is necessary to apply heat to the cross-linking reaction, as is well known in the art. However, when the cross-linking reaction takes place in the presence of the toner particle compositions of said Ser. No. 679,906, it is preferred to avoid elevated temperatures in order to protect the morphology of the fiber particles. The polysiloxane reactants are admixed in a nonpolar dispersant oil, such one of the ISOPARs, in proportion of between about 1-10 parts of total polysiloxane reactants for 100 parts of ISOPAR.

In one preferred embodiment 5 parts of Dow Corning SYL-OFF 7600 and 0.5 parts of Dow Corning SYL-OFF 7601 were combined with 94.5 parts of ISOPAR H and heated to 95° C. until a gel was formed. The gel was allowed to cool to room temperature and ground.

The silicone material (including the ground gel) may be combined with the toner particle compositions, such as the toner compositions described in said Ser. No. 679,906, in proportion of between about 1 percent up to 30 percent on the weight of toner particles in the toner formulation. When ground gels are admixed with the toner compositions, it is preferred that the ground gel comprise about 10 percent of the toner particles, and when the release agent is a silicone oil, it is preferred that the silicone oil comprises about 5 percent of the toner particles. In the case of the silicone oil, the lesser quantities are based on economic considerations. Higher proportions of silicone oils tend to make the toner composition foam and interfere with the operability of the electrostatic reproduction machine.

The admixture of ground gel and image toner particle compositions is preferably made up of particles of similar mesh size, but the admixture may be ground until the particles are about the same size. The modified toner particle compositions of this invention may be used to prepare liquid toner compositions for use as developers for latent electrostatic images on photoconductors. The developed image may then be readily transferred by means well know in the art to carrier surfaces to provide improved permanent images.

It is also within the scope of this invention to use other agents to obtain apparent increased cohesivity of the toner particles and reduced wicking of the nonpolar carrier liquid that is carried over to the carrier sheet thereby improving the transfer efficiency and reducing image squash. Such cohesivity increasing agents other than the silicone material described previously include various ground gels. When such other agents are used separate silicone materials may be admixed with the liquid toner composition to provide reduced adhesivity of the image toner particles to the photoconductor surface. Other materials that are useful for increasing the apparent cohesivity of the toner particles include thermoplastic polyamide resins. Gels of such materials may be formed by mixing the resin with a dispersant liquid, such as the ISOPARS, until the appropriate gel is prepared. Heat may be applied to promote gel formation. Thereafter the gel may be ground in the presence of a dispersant liquid or combined with the liquid toner dispersion and then ground. The proportion of such other resins to toner particles may be up to about 30% by weight of the toner particles; 5-20% is the preferred range.

The silicone materials and gels described herein are combined with the liquid toner composition, including a charge director, as previously described. Transfer efficiencies in the range of 90 percent to 95 percent are obtained.

The following examples illustrate the principles and practices of the invention and are not intended to limit its scope in any way. All percentages are by weight unless otherwise indicated.

EXAMPLES

Example 1—Preparations of Silicone Gels

A. Elevated Temperature. 50 grams of Dow Corning SYL-OFF 7600, 5 grams of Dow Corning SYL-OFF 7601 and 1,045 grams of ISOPAR H were mixed in a glass beaker with a mechanical stirrer. SYL-OFF 7600 contains a platinum catalyst; SYL-OFF 7601 contains an inhibitor of polymerization. The mixture was heated up to a temperature of about 94° C. with stirring for about ½ hour, during which time gelation occurred. The gel was allowed to cool to room temperature to form a 5% gel.

B. Reduced Temperature. 6 grams of Dow Corning SYL-OFF 7600, 0.6 grams of Dow Corning SYL-OFF 7601 and 166 grams of hexane were heated to 60° C. for about 4 hours and thereafter the mixture was stored in a refrigerator at between 2° C. and 5° C. for about seven days. The material gelled within that time.

C. Room Temperature. 5 grams of Dow Corning SYL-OFF 7600, 0.5 grams of Dow Corning SYL-OFF 7048 (cross-linker without polymerization inhibitor) and 105 grams of ISOPAR H were mixed for about ½ hour and then stored for 48 hours at room temperature (about 20° C.) at which time gelation occurred.

D. Elevated Temperature. 136 grams of Dow Corning SYL-OFF 7600, 13.6 grams of Dow Corning SYL-OFF 7601 and 1,350 grams of ISOPAR H were combined and heated under stirred conditions to about 90° C. Gelation occurred immediately to form a 10% gel.

Example 2—Preparation of Fiber Toner Particles

Fiber particles were prepared by a process similar to the process of Example 1 of said Ser. No. 679,906. The process consisted essentially of combining 500 grams of ELVAX II polymer 5720, and 500 grams of ISOPAR L at 75° C. After mixing for about 30 minutes, 125 grams of carbon black (Mogul L, sold by Cabot Corp.) was added and mixing was continued in a Ross double planetary mixer for about one hour at 90° C. Additional ISOPAR L was added to provide a mixture of 30% solids and 70% ISOPAR L and mixing was continued at 90° C. for 30 minutes. Thereafter the temperature was allowed to come to room temperature with continued mixing over a period of 4 hours. This material was further diluted with ISOPAR H to a 13.35% by weight non-volatile solids composition and the composition was ground with ½ inch $Al_2O_3$ cylinders in an M-18 Sweco vibratory mill (approximate loading volume 2 gallons) for about 24 hours at room temperature. This material is referred to herein as the toner concentrate.

The toner concentrate without charge director was then diluted to a 1.5% by weight non-volatile solids concentration with ISOPAR H. 0.6 grams of lecithin dissolved in 5.4 grams of ISOPAR H was added to 1,500 grams of the diluted toner dispersion. Lecithin was the charge director. The 1.5% liquid toner composition was used as a developer for electrophotographic images in a Savin 870 copier. The transfer efficiency of the pigmented toner particles was between about 88% and 90%. (The longer grinding time in Example 1 of said Ser. No. 679,906 resulted in a slightly higher transfer efficiency.)

Example 3—Preparation of Silicone Modified Fibrous Particle Toner Compositions

A. 1,000 grams of the gel of Example 1A. was ground for 6 hours at room temperature in an S-1 attritor with 3/16 inch stainless steel balls. The viscosity of the ground gel decreased with time from about 5,000 centipoise to about 160 centipoise and fine particles were obtained.

B. 168.5 grams of the toner concentrate of Example 2 were mixed with 45 grams of the ground gel of Example 3A. together with 1,286 grams of ISOPAR H. The materials were shaken together for a few minutes and thereafter used as a developer in a Savin 870 copier. Using lecithin as the charge director the transfer efficiency was 98.8%.

C. 824 grams of the toner concentrate of Example 2 were mixed with 330 grams of the ground gel of Example 3A. and ground together in an S-1 attritor for about ½ hour. Using lecithin as a charge director and diluted to 1.5% non-volatile solids, the transfer efficiency was about 96%.

D. 1,000 grams of the toner concentrate of Example 2 were mixed with 4 grams of Dow Corning Anchorage Agent 297 (described as a "complex reactive silicone") for about 4½ hours at 40° C. in a Kady mill. 807 grams of this material were combined with 19.5 grams of Dow Corning SIL-OFF 7600, 2 grams of Dow Corning SIL-OFF 7048 and 500 grams of ISOPAR H. The mixture was stirred for 12 hours at room temperature. After diluting to about 1.5% non-volatile solids and adding lecithin as the charge director, the transfer efficiency was about 98%.

Example 4

A. The process of Example 3B. was repeated except that the proportion of the ground gel was 22.5 grams, the amount of ISOPAR H was 1,309 grams and 0.45 grams of UCARSIL-T-29 (an epoxy polysiloxane sold by Union Carbide) was added to the mixture. Continuous "sky shots" (i.e.. 100% image area coverage copies), all made in a Savin 870 machine with lecithin as the charge director, resulted in very good sliding of one copy on top of the other in the paper output tray thereby demonstrating the improved slip characteristics derived from this invention.

B. The process of Example 4A. was repeated except that 0.45 grams of di-tridecyl sodium sulfosuccinate (as the charge director) dissolved in 4.05 grams of ISOPAR H was used in place of lecithin. The sodium sulfosuccinate was obtained from AEROSOL TR-70 which is sodium sulfosuccinate in a polar solvent. The polar solvent was evaporated and the ISOPAR H was added. The transfer efficiency was 94%. This compared to a transfer efficiency of about 70% with a control that comprised 168.5 grams of the toner concentrate of Example 2 which had been diluted with 1331.5 grams of ISOPAR H and using the same sodium sulfosuccinate as the charge director, but without ground gel and UCARSIL T-29.

C. When about 2.25 grams of basic barium petronate dissolved in 20.25 grams of ISOPAR H was used as the charge director in Example 4B., the transfer efficiency was 96% compared to a transfer efficiency in a control (i.e., without the ground gel and UCARSIL T-29) of about 85%.

D. 168.5 grams of the toner concentrate of Example 2 was mixed with 135 grams of ground gel of Example 3A. and 1196.5 grams of ISOPAR H. The mixture was shaken for a few minutes. When lecithin was used as the charge director, the transfer efficiency was 99% compared to the transfer efficiency of a control (i.e., without the ground gel of Example 3A.) of about 88%.

Example 5

45 mgs. of Dow Corning D-536 (described as an amino terminated dimethylsiloxane polymer) was mixed with 168.5 grams of the toner concentrate of Example 2, 1,329 grams of ISOPAR H and 0.23 grams of lecithin dissolved in 2.07 grams of ISOPAR H. After mixing for 24 hours the composition was used as a developer. The carrier paper showed improved fill of solid areas and text compared to a control that did not have the Dow Corning D-536 added thereto.

Example 6

A. The procedure of Example 2 was repeated except that the toner concentrate was ground in the M-18 Sweco vibratory mill at 40° C. and thereafter diluted to 1.5% toner dispersion of non-volatile solids. This material was used as a developer with lecithin as the charge director. The transfer efficiency was about 94%. The higher grinding temperature resulted in the improved transfer efficiency with respect to the transfer efficiency of the toner dispersion of Example 2.

B. When 1,500 grams of the same liquid toner dispersion as in Example 6A. (with lecithin) had 0.675 grams of Dow Corning silicone DC-200 (30,000 centistokes) added, the transfer efficiency improved to 98%.

C. Similar improvements in transfer efficiencies resulted in the following Example. 20 grams of Dow Corning SYL-OFF 292 and 0.3 grams of Dow Corning 2-7131 (a fast curing agent) were heated with 0.6 grams of Dow Corning DC-176 catalyst and 237.3 grams of ISOPAR to 120° C. with stirring for 4 hours, after which time cross-linking occurred. 37.5 grams of the cross-linked material, which was a high viscosity liquid was added to about 1,500 grams of the toner dispersion of Example 6A. and shaken. When used as a developer (with lecithin) the transfer efficiency improved from said 94% to 97.7%.

D. General Electric RTV-630A (30 grams) was mixed with General Electric RTV-630B (3 grams) as the curing agent in 407 grams of ISOPAR H. After heating to 128° C. gelation occurred. The gel was ground at room temperature in an S-O attritor with 3/16 inch stainless steel balls for 24 hours. 30 grams of the ground composition were shaken with about 1,500 grams of the toner dispersion of Example 6A. and used as a developer (with lecithin). The transfer efficiency was about 98% compared to said 94% for the control.

Example 7

The ground gel of Example 3A. was added to the following prior art liquid toner compositions and the results indicated were obtained.

A. Toner for the Canon NP-80 Machine. 1,500 grams of a 1.5% non-volatile solids mixture of the Canon toner had a transfer efficiency of 70%, and after 45 grams of the ground gel of Example 3A. was added, the transfer efficiency increased to 74%.

B. Hunt 11 SN 6800-B Toner. The transfer efficiency of this toner diluted to 1.5% was 55%. After the addition of 45 grams of the ground gel of Example 3A. to 1,500 grams of the diluted Hunt toner, the transfer efficiency increased to 60%.

C. Savin V-35 Toner (Ricoh R-50). This toner, diluted to 1.5% had a transfer efficiency of 77%. With the addition of 45 grams of the ground gel of Example 3A. to 1,500 grams of said diluted Ricoh toner, the transfer efficiency was 78%, and improved optical density and image uniformity were observed.

Example 8—Other Gels

A. Ultrasonic Mixing/Lower Temperatures. VERSAMIDE 335, a thermoplastic polyamide resin made by Henkel, U.S.A., is added to ISOPAR H in proportion of about 3 g. of VERSAMIDE 335 with 100 g. of ISOPAR H. (The VERSAMIDE-ISOPAR admixture may contain between about 1-5 parts by weight of VERSAMIDE for 100 part by weight of ISOPAR.) The components are then mixed using an ultrasonic probe at maximum intensity for about 45 minutes. (A Fritsch Laborette ultrasonic probe may be used.) The mixture is cooled to about 35° C., or below, during the ultrasonic mixing step. (A Cole-Palmer cooler finger may be used.) A thixotropic gel is formed during this ultrasonic mixing process.

B. Elevated Temperature. 1-5 g. of VERSAMIDE 335 are mixed with 100 g. of ISOPAR H. in a beaker and heated on a hot plate to about 115° C. while stirring. After 15 minutes the stirring is stopped and heat is turned off. The admixture is allowed to cool to room temperature while a gel is formed.

Example 9—Methods of Combining Gel with Toner Compositions

A. The gel of Example 8A. or 8B. is added to the 1.5% by weight non-volatile solids toner composition (without charge director) of Example 2, above, and dispersed in a Kady Mill for 1-2 minutes at maximum shear (about 10,000 rpm).

B. The gel of Examples 8A. or 8B. is mixed with the 13.35% parts by weight non-volatile solids toner concentrate of Example 2, above, and ground in a S-O attritor for about 1-2 hours.

C. 100 g. of the gel of Example 8A. or 8B. is added to 1400 g. of ISOPAR H and sonicated together for 5 minutes at maximum intensity using an ultrasonic probe (Fritsch Laborette). The disintegrated gel is mixed with toner composition by shaking.

D. The gel of Example 8A. or 8B. is ground for about hours in an S-O attritor. The ground gel is mixed with toner composition by shaking.

Example 10—Preparation of Gel Modified Fibrous Particle Toner Compositions

A. A gel is prepared as in Example 8B. in proportion of 1 part by weight VERSAMIDE 335 and 99 parts by weight ISOPAR H. 450 g. of the gel is added to 168.5 g. of the toner concentrate of Example 2, above, together with 881.5 g. of ISOPAR H. These materials are mixed together in a Kady Mill for 1-2 minutes at maximum shear (about 10,000 rpm) as described in Example 9A., above. Lecithin is used as the charge director, and this liquid toner composition is used as a developer for electrophotographic images in a Savin 870 copier. The transfer efficiency is 93.3% compared to a transfer efficiency of 88%-90% when the unmodified liquid toner composition of Example 2 was used.

B. A gel prepared as in Example 8B. in proportion of 1 part by weight VERSAMIDE 335 and 99 parts by weight ISOPAR H. 112.5 g. of this gel is added to 168.5 g. of the Example 2 toner concentrate and ground in an S-O attritor for 2 hours as described in Example 9B., above. Thereafter 1219 g. of ISOPAR H are mixed with the ground gel-toner mixture to make a 1.5% non-volatile solids toner dispersion. Lecithin is added to the dispersion as the charge director, and the toner dispersion is used as a developer. The transfer efficiency is 93%

C. A gel is prepared as in Example 8B. in proportion of 3 parts by weight VERSAMIDE 335 and 97 parts by weight ISOPAR H. 112.5 g. of this gel is ground for 6 hours in an S-O attritor as described in Example 9D. The ground gel is mixed with 168.5 g. of the toner concentrate of Example 2 by shaking the admixture with 1219 g. of ISOPAR H. Lecithin is used as the charge director, and the transfer efficiency is 93%.

D. A gel is prepared as in Example 8B. in proportion of 5 parts by weight VERSAMIDE 335 and 95 parts by weight ISOPAR H. This gel is ground for 6 hours in an S-O attritor as described in Example 9D. 22.5 g. of the ground gel is mixed with 168.5 g. of the toner concentrate of Example 2 by shaking the admixture with 1309 g of ISOPAR H. Lecithin is used as the charge director, and the transfer efficiency is 93.6%

In the examples herein, the toner images were transferred to paper sheets conventionally used in electrostatic image reproduction machines. These techniques are well known in the art. The transferred images were clear, sharp, had high resolution and line acuity. Image defects were reduced or eliminated; the optical density was increased compared to prior art images, and pinholes, non-uniform image areas, and hollow areas in the image areas were likewise reduced or eliminated. Halos or spots in the highlight areas were also reduced or substantially eliminated. Wicking in the carrier sheets was also found to have been substantially eliminated. After fixing the images on the carrier sheets, dry clean paper copies of the image were obtained.

It is preferred that the gels of Example 1 be ground for approximately 11 hours in order to insure that the ground gel does not re-gelate during storage. The preferred method of combination of the liquid toner composition and the silicone materials is by mixing or shaking of the two components.

The herein referred application Ser. No. 679,906, filed Dec. 10, 1984 has been replaced by continuation application Ser. No. 45,168 filed Apr. 24, 1987, which has been replaced by continuation application Ser. No. 157,122 filed Feb. 10, 1988 which issued as U.S. Pat. No.

4,794,651 on Dec. 27, 1988. Ser. No. 679.906 has been allowed to become abandoned in favor of Ser. No. 45,168, and all references herein to Ser. No. 679,906 should be understood as referring to continuation Ser. No. 45,168, similarly all references herein to Ser. No. 45,168 should be understood as referring to continuation Ser. No. 157,122 and U.S. Pat. No. 4,794,651 issuing therefrom.

It will be understood that it is intended to cover all changes and modifications of the examples of the invention herein chosen for the purpose of illustration which do not constitute departures of spirit and scope of the invention.

We claim:

1. A method of preparing a liquid toner composition for development of latent electrostatic images comprising:

adding a polymerized ground gel to a dispersion of toner particles in a liquid dispersant.

2. The method of claim 1 further comprising: adding an agent causing an apparent increase in the cohesivity of said toner particles to said toner concentrate.

3. The method of claim 1 wherein said gel comprises at least one silicone material, operative to facilitate release of a developed image from an image forming surface which carries the latent electrostatic image.

4. The method of claim 3 wherein said silicone material is a polymeric siloxyane having a repeating silicon-oxygen linkages in the polymer backbone.

5. The method of claim 3 wherein said silicone material is present in the range of up to about 30% by weight based on the weight of the toner particles.

6. The method of claim 5 wherein said silicone material is in gel form.

7. The method of claim 1 wherein said ground gel is operative to cause an apparent increase in cohesivity of the toner particles.

8. The method of claim 2 wherein said agent causing an apparent increase in cohesivity of said toner particles is a ground gel.

9. The method of claim 8 wherein the ground gel is a thermoplastic polyamide resin.

10. The method of claim 9 wherein said agent is present in the range of up to 30% by weight of said toner particles.

11. The method of claim 2 wherein the proportions of said ground gel on the basis of said toner particles is up to about 30% by weight percent and the proportion of said agent causing an apparent increase in the cohesivity of said toner particles on the basis of said toner particles is up to about 30% by weight.

12. A developed electrostatic image that has been developed with a toner composition prepared according to the method of claim 1.

13. A developed electrostatic image that has been developed with a toner composition prepared according to the method of claim 2.

14. A carrier sheet comprising a toner image produced with a toner composition prepared according to the method of claim 1.

15. A carrier sheet comprising a toner image produced with a toner composition with improved release prepared according to the method of claim 2.

* * * * *